United States Patent [19]

Howard

[11] Patent Number: 4,867,360

[45] Date of Patent: Sep. 19, 1989

[54] CLEANING UTILITY BELT

[76] Inventor: Brent A. Howard, 900 Lennix Dr., Redwood Valley, Calif. 95470

[21] Appl. No.: 285,729

[22] Filed: Dec. 16, 1988

[51] Int. Cl.[4] ..... B65D 25/10

[52] U.S. Cl. ..... 224/245; 224/148; 224/268; 248/314

[58] Field of Search ..... 224/148, 208, 211, 215, 224/216, 223–226, 231, 240, 242, 245, 246, 252, 253, 262, 268, 269, 901, 904, 908, 914, 919, 920; 206/223, 581; 15/257; 248/314

[56] References Cited

U.S. PATENT DOCUMENTS

| | | | |
|---|---|---|---|
| 625,752 | 5/1899 | Ford | 248/314 |
| 2,753,100 | 7/1956 | Montgomery | 224/268 X |
| 2,758,798 | 8/1956 | Schmidt | 224/904 X |
| 2,817,472 | 12/1957 | Parkhurst | 224/920 X |
| 3,274,476 | 9/1966 | Wildum | 224/224 X |
| 3,445,046 | 5/1969 | Wilson | 224/148 |
| 4,330,073 | 5/1982 | Clark | 224/223 |
| 4,377,240 | 3/1983 | Kleps | 211/87 |
| 4,449,654 | 5/1984 | Cappis | 224/148 |
| 4,475,660 | 10/1984 | Cain | 211/113 |
| 4,676,419 | 6/1987 | Victor | 224/252 |

*Primary Examiner*—Henry J. Recla
*Assistant Examiner*—Robert M. Fetsuga
*Attorney, Agent, or Firm*—Richard C. Litman

[57] ABSTRACT

A plurality of appropriately sized and shaped containers and hooks are affixed to a belt in such a manner as to enable a person engaged in the light maintenance or janitorial profession and using such an apparatus to more efficiently perform his duties by means of the carriage of appropriate equipment and supplies at easily accessible locations around the perimeter of the belt.

4 Claims, 1 Drawing Sheet

CLEANING UTILITY BELT

FIELD OF THE INVENTION

This invention relates generally to a novel and improved apparatus for general maintenance and janitorial work, and more specifically to a device enabling persons performing such work to do so more easily and efficiently by the use of this invention.

BACKGROUND OF THE INVENTION

Persons engaged in general building maintenance, and cleaning and janitorial work, need and use a great variety of supplies, tools, and equipment in their work. Often this requires either frequent trips to a central location to obtain various cleaning and polishing materials, towels, keys for access to secured areas, etc., or use a cart in order to carry such supplies and equipment.

Obviously, multiple trips between the work area and storage area for supplies and equipment leads to lower productivity. One solution to this is some form of cart which can be pushed or pulled by the maintenance person as he makes his rounds. Such carts are unsuitable in many work environments, however, due to their size and inability to fit through or into many areas and the difficulty in ascending and descending stairways with such a cart when no elevator is close at hand.

The inventor is aware of many specially designed items of apparel, such as vests, belts, and the like intended for various specific uses, such as the carriage of electrical batteries, paint cans, and/or other equipment. Cappis U.S. Pat. No. 4,449,654 of May 22, 1984 and Chindgren U.S. Pat. No. 1,109,161 of Sept. 1, 1914 disclose such devices. While these devices would be suitable for the carriage of various containers, access would be relatively cumbersome due to the system of straps and/or the bulky fit of the carrier itself. Also, no small parts or liquids removed from their individual containers could be carried due to the open bases of the individual sections.

Other inventions, such as Wildum U.S. Pat. No. 3,274,476 of Sept. 20, 1966 also disclose belt devices for the purpose of carrying various articles. The Wildum patent, however, discloses individual containers completely enclosed, which renders their contents relatively inaccessible. None of the patents known to exist disclose devices readily adaptable for use in the janitorial field, or even suitable for such use without major modification so as to completely alter the utility of the device.

SUMMARY OF THE INVENTION

By the present invention, a novel and improved apparatus for the conveyance of janitorial and light maintenance equipment and supplies is disclosed.

Accordingly, it is an object of the present invention to provide an improved means for the conveyance of such equipment and supplies, by providing a belt and container system specifically designed for such purpose.

It is a further object of the present invention to provide for the orderly carriage of janitorial and light maintenance equipment and supplies by means of appropriate containers and hooks affixed to a belt in an orderly manner, such that those objects and supplies most commonly used will be most easily accessible.

Another object of the present invention is to provide for the possibility of differing arrangements of said containers and hooks, by providing for their attachment to said belt by means of clips, or some other easily removable temporary attachment in one variation of said present invention.

An additional object of the present invention is the provision of specially prepared hooks, roughened or surfaced with material of a relatively high friction coefficient, so as to prevent the slippage of towels or other objects carried thereon.

It is yet another object of the present invention to provide specifically shaped containers in the general form of a funnel or containing a funnel like insert for the carriage of handled brushes and the like commonly used in the janitorial trade.

With these and other objects in view which will more readily appear as the nature of the invention is better understood, the invention comprises the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
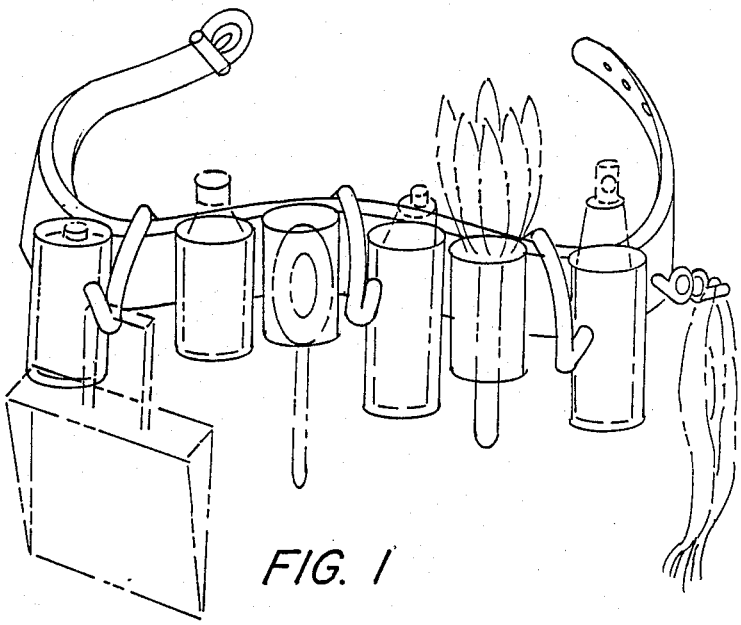
FIG. 1 is a perspective view of the utility belt with various articles of equipment and supplies installed.

Referring to FIG. 1 of the drawings, the present invention 1-11 will be understood to relate to a novel and improved apparatus for the conveyance of various light maintenance and janitorial equipment and supplies, having a belt upon which various canisters, hooks, and other devices are attached. This figure also depicts various articles of ancillary equipment and supplies carried by the apparatus.

Figure 2:
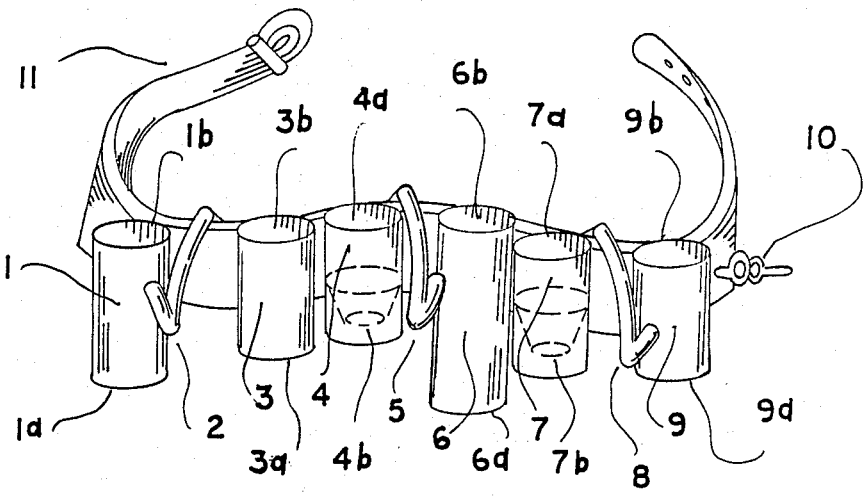
FIG. 2 is a side view of the utility belt with ancillary articles removed and said belt extended for greater clarity.

In FIG. 2 the detailed arrangement of the invention 1-11 may be more clearly seen. A properly sized and shaped canister 1 with enclosed bottom 1*a* and open top 1*b* for the carriage of disinfectant or other like products is depicted, attached toward the left end of belt 11. Hook 2 consisting of a relatively thin, stiff material with a relatively high friction coefficient surface for the carriage of a utility towel or similar object; it is attached to belt 11 immediately to the right of canister 1. Canister 3 consisting of a properly sized and shaped container with enclosed bottom 3*a* and open top 3*b* for the carriage of a cleansing product or like agent is depicted attached to belt 11 next to hook 2. Canister 4 consisting of a properly sized and shaped container with open top 4*a* and funnel shaped insert 4*b* for the carriage of a toilet mop or the like, or a funnel shaped container for the carriage of such object, is depicted attached to belt 11 next to canister 3. Hook 5 consisting of a relatively thin, stiff material properly shaped for the carriage of a dust pan or similr object is depicted attached to belt 11 next to canister 4. Canister 6 consisting of a properly sized and shaped container with enclosed bottom 6*a* and open top 6*b* for the carriage of a container of wax, polish or the like is depicted attached to belt 11 next to hook 5. Canister 7 consisting of a properly sized and shaped container with open top 7*a* and funnel shaped insert 7*b*, or funnel shaped container, for the carriage of a feather duster or similar device is depicted attached to belt 11 next to canister 6. Hook 8 consisting of a relatively thin, stiff material with relatively high friction coefficient surface for the carriage of a wax or polish towel or similar object is depicted attached to belt 11 next to canister 7. Canister 9 consisting of a properly sized and shaped container with enclosed bottom *9a* and open top *9b* for the carriage of glass cleaner or similar product is depicted next to hook 8. Hook 10 consisting of a relatively thin, stiff material coiled so as to securely hold an appropriately modified towel or similar with eyelet, key ring, or the like is depicted attached to belt 11 next to canister 9. The above containers and hooks 1 through 10 may be attached to said belt 11 by either temporary or permanent means, such as clips, rivets, or other fastening means, and of course in the embodiment including temporary attachments means may be placed on belt 11 in any arrangement or order suitable to the user of the invention.

It is to be understood that the present invention is not limited to the sole embodiment described above, but encompasses any and all embodiments within the scope of the following claims.

What is claimed is:

1. A carrying apparatus comprising;

a flexible belt adapted to be worn about the body and having an outer face, a plurality of canisters attached to said belt, said canisters defining a generally cylindrical configuration and having an outer surface surrounding a central cavity, said canisters attached to said belt with said outer surface overlying the full width of said belt outer face, hook members on said belt having a periphery exhibiting a high coefficient of friction, and article retention means within a plurality of said canister cavities adapted to retain articles therein as utilized in the maintenance and janitorial industry.

2. The apparatus of claim 1 wherein, said hook member peripheries include an uncoated, roughened surface.

3. The apparatus of claim 1 wherein, said article retention means include a funnel shaped insert.

4. The apparatus of claim 1 wherein, said canisters and hooks include means permitting the selective detachment thereof from said belt.

* * * * *